US006383008B1

(12) United States Patent
Wagner

(10) Patent No.: US 6,383,008 B1
(45) Date of Patent: May 7, 2002

(54) ANGULAR SUPPORT FOR A PLUG CONNECTOR

(75) Inventor: Heinrich Wagner, Schöfweg (DE)

(73) Assignee: Interconnectron GmbH, Deggendorf (DE)

( * ) Notice: Subject to any disclaimer, the term of this patent is extended or adjusted under 35 U.S.C. 154(b) by 0 days.

(21) Appl. No.: 09/744,636

(22) PCT Filed: Jul. 13, 1999

(86) PCT No.: PCT/DE99/02184

§ 371 Date: Mar. 21, 2001

§ 102(e) Date: Mar. 21, 2001

(87) PCT Pub. No.: WO00/07265

PCT Pub. Date: Feb. 10, 2000

(30) Foreign Application Priority Data

Jul. 28, 1998 (DE) ..... 198 33 923

(51) Int. Cl.[7] ..... H01R 13/627
(52) U.S. Cl. ..... 439/350
(58) Field of Search ..... 439/350, 321, 439/320, 89, 680, 95, 695, 684

(56) References Cited

U.S. PATENT DOCUMENTS 4,277,125 A * 7/1981 Ball ..... 439/113 R

* cited by examiner

*Primary Examiner*—Gary Paumen
*Assistant Examiner*—Phuongchi Nguyen
(74) *Attorney, Agent, or Firm*—Sidley Austin Brown & Wood, LLP

(57) ABSTRACT

An angular plug support having a socket part an angular support part having a first limb for receiving a contact-retaining insulator, and a second limb overlapping the socket part with a possibility of rotation relative thereto but without a possibility of an axial displacement relative thereto, and a locking device provided in a region of an overlapping of the socket part by the second limb for securing the angular support part in its selected rotational position with respect to the socket part and including a plurality of rigid flat surfaces provided on an outer periphery of the socket part or an inner periphery of the second limb, and a respective plurality of radially spring-biased surfaces provided at another of an outer periphery of the socket part and the inner periphery of the second limb.

7 Claims, 3 Drawing Sheets

ANGULAR SUPPORT FOR A PLUG CONNECTOR

BACKGROUND OF THE INVENTION

1. Field of Invention

The invention relates to an angular plug support, especially for attachment to a unit housing, consisting of a socket part, which can be secured to the unit housing so that it remains fixed thereto and does not rotate, and an angular support, partially overlapping this socket part with one of its limbs and connecting it rotatably but axially immovably by means of a mutual positive engagement, for accommodating an insulator holding the plug contacts, the socket part and the limb of the angular support, facing it, being equipped in the region, in which they mutually overlap, with a locking device, by means of which they can be fixed mutually in a selectable position of rotation of the angular support.

2. Description of the Prior Art

Such an angular plug support, equipped with a locking device, is known particularly from the German Offenlegungsschrift 195 20 544, in accordance with which in groove recesses equipped in the socket part and in the limb of the angular support, assigned to this socket part, with circumferential projections, provided in the region of their mutual overlapping, directed in opposite directions and forming a type of denticulation in their recess base, a connecting piece is disposed, which is constructed elastically in the radial direction, has an outline shape deviating from the strictly circular along its inner and outer periphery and interacts with projections in the recess base. At least in one realized form, the connecting piece can be formed by a corrugated spring and, interacting with the projections in the recess base, enables the socket part and the angular support to be locked together in a number of freely selectable swiveled positions. In the case of this construction of the connection between the stationary socket part and the angular support, which can be swiveled about its axis relative to the stationary socket part, a single part, namely the corrugated spring, forms, on the one hand, the removal resistant connection between the socket part and the support and, on the other, at the same time also the surmountable, mutual protection against twisting or the locking of the socket part and the support in a selected rotated position. In order to be able to fulfill these two tasks as befits the connection between the socket part and the support, on the one hand, a careful configuration of the corrugated spring and, on the other, a precise construction of at least the groove recess having the stop marks or the radial projections forming such marks, is required. As a result, on the one hand, the manufacturing costs are relatively high and, on the other, the assembly of the plug support is also appreciably more difficult.

Starting out from this state of the act, it is an object of the invention to improve an angular plug support of the construction described above, so that, while the manufacturing costs are less and the number of lockable positions between the socket part and the support do justice to practical requirements, it is sufficiently secured against any unintentional adjustment of a set swiveling position by a slight contact or also under the influence of vibrations unavoidable under the influence of machine units.

SUMMARY OF THE INVENTION

This objective is accomplished pursuant to the invention for an angular plug carrier of the construction indicated above, owing to the fact that the locking device, provided in the region of mutual overlapping of the socket part and the limb of the angular support, comprises from the outer periphery of the one part to the inner periphery of the other part, lying mutually opposite to one another, on the one hand at least two rigid, flat surfaces and, on the other, a corresponding number of radially adjustable, also flat surfaces, the flat surfaces being disposed in such a manner that, when the support is in a locked position, all surfaces are in mutual, two-dimensional contact with one another.

Accordingly, the invention is distinguished, on the one hand, by a separation of the functions of an axial removal resistance and of a locking device for the surmountable mutual fixing of socket part and support and, on the other, simultaneously a limitation of the possible, locked swiveling positions to the number, which can actually be used in the respective application case of the plug support, with the consequence of a comparatively advantageous possibility for manufacturing the individual parts and a simplified assembly of the plug support. Moreover, the possibility exists in an advantageous manner of adjusting the height of the spring load in such a way, that mutual rotation between the socket part and the support can still be brought about, admittedly, by hand, but preferably by means of a tool and, in any case, an unintentional, automatic change in the swiveling position of the support relative to the socket part, under the influence of unavoidable machine unit vibrations or also as a result of unintentional touching, such as can occur when handling machine devices or installations, for example, as stiffening contact or the like, is excluded. In this connection, the inventive locking is distinguished as a result of the interaction of flat pairs of surfaces and, with that, as a result of a relatively high locking force.

With the inclusion of the disclosure of the obvious possibility of a reversal of the arrangement of a rigid locking surface, supported elastically in the radial direction, a preferred realization sees to it that the locking device, disposed in the region of the overlapping of the one limb of the angular support with the socket part, has at least two rigid and flat locking surfaces, which are constructed tangentially to its outer periphery and to which are assigned a corresponding number of equally flat surfaces, which are disposed at the inner periphery of the limb of the support and can be moved radially against a spring load.

Admittedly, it is completely adequate for many applications, if the angular support can be locked with respect to the socket part only in two positions rotated at an angle of 180° to one another. However, in the interest of decreasing the type diversity and, with that, optimizing inventory, it may be of particular advantage if the angular support can be locked in four the different positions with respect to the socket part, especially in positions rotated in each case by 90° to one another. For this purpose and pursuant to a preferred realization, provisions are made so that the locking device has an even number, especially eight, of pairs of the flat surfaces, interacting with one another to produce a locking force, and constructed in a uniform arrangement. In an advantageous embodiment of this realization, it may furthermore be provided that all flat surfaces, constructed at the outer periphery of the socket part and all flat surfaces constructed in the inner periphery of the limb of the support, have the same size, as a result of which the manufacture of the parts involved is simplified.

In particular, in an advantageous further development of the preferred realization, provisions are made so that the flat surfaces, which can be moved radially against a spring load, are formed by leaf spring sections and, bridging radially directed, groove-shaped recesses, are disposed in the part accommodating them, especially in the angular limb of the support. Insofar as the leaf spring sections in each case are constructed as individual parts and, independently of one another, are inserted in the groove-shaped recesses, the groove-shaped recesses advisably have supporting regions forming supporting surfaces for the side edges of the leaf spring sections on either side of and parallel to their longitudinal extent.

In particular, in conjunction with the use leaf spring sections, constructed as individual parts and inserted independently of one another in the groove-shaped recesses, a further advantageous embodiment for the realization of a locking arrangement between the socket part and the support, which is characterized by the interaction of surface pairs, arises owing to the fact that, in the unloaded state, the leaf spring sections, forming the flat surfaces, which can be moved radially against a spring load, always have a pretension curvature facing the opposite surface.

In order to achieve a simplification in the assembly for the swiveling positions of the socket part and the support in a locking device having a plurality of possible locking positions, provisions can be made in accordance with a further embodiment so that the leaf spring sections, forming flat surfaces movable radially against the spring load, are connected with one another by bridges to form a polyhedral ring body. On the one hand, this makes possible a simultaneous installation of all leaf springs, required for any number of locking positions and, on the other, an optimum support of the individual leaf spring sections at the part of the angular plug support carrying them.

In a further advantageous embodiment, provisions can furthermore be made so that the rigid, flat surfaces, formed at the external periphery of the socket part, and the intermediate surfaces, keeping them apart, are constructed identical in size and together form the outline of a regular polygon.

BRIEF DESCRIPTION OF THE DRAWINGS

The invention is described in detain below with reference to two embodiments which are shown in the drawings in which.

DETAILED DESCRIPTION OF THE PREFERRED EMBODIMENT

Figure 1:
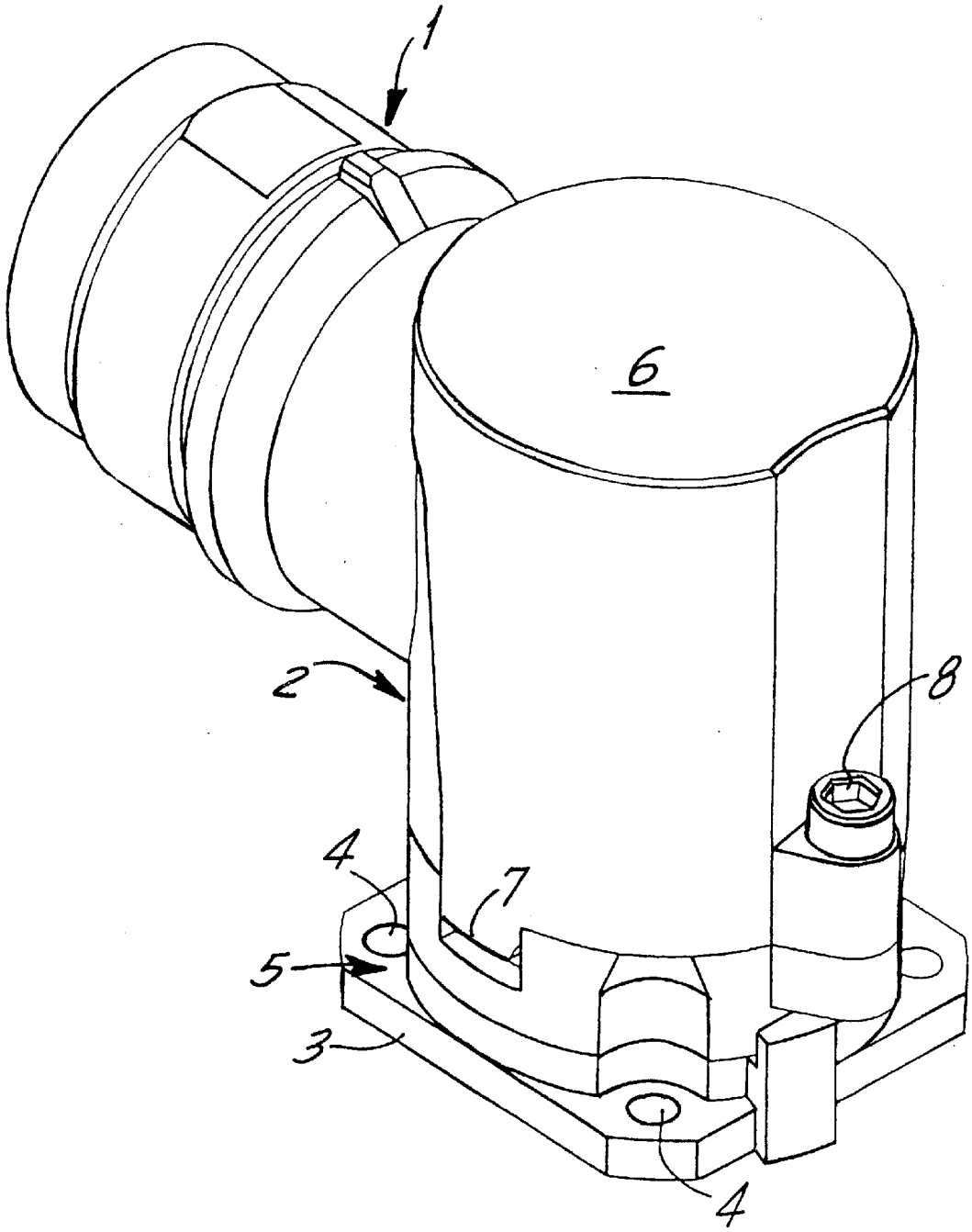
FIG. 1 shows a diagrammatic representation of an angular plug support.
Figure 2:
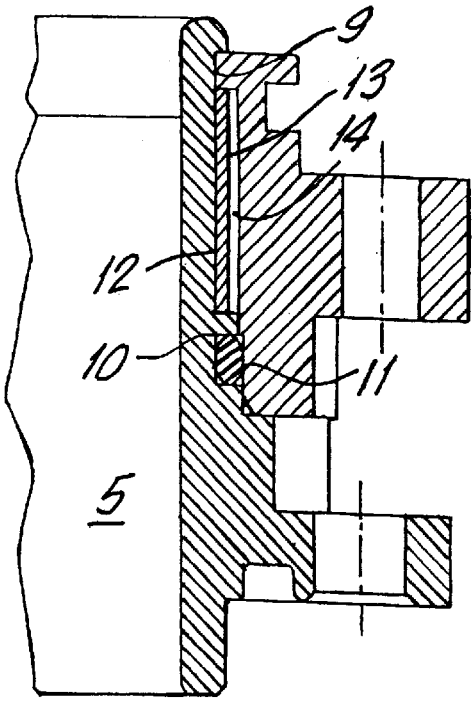
FIG. 2 shows a section through the plug support of FIG. 1 along the line II—II.

The means for attaching an angular support, comprising two limbs 1 and 2, which are aligned at right angles to one another, to a unit, the details of which are not shown in the drawing, especially to an engine housing, consist mainly of a socket part 5, which can be fixed in a stationary and nonrotating manner to the unit housing by means of a flange 3 with at least four borehole recesses 4, which are assigned to screw bolts, which are not shown in the drawing. The one limb 1 of the angular support is assigned to accommodate an insulator, the details of which are not shown and which forms the fixture for holding the contacting means of a plug. The angular region of the angular plug support has an installation opening, which is overlapped by the covering hood 6 and intended for the electrical equipment. The covering hood 6 is connected positively by means of axial protrusions 7 and at least one fastening screw 8 with the limb 2 of the support, facing the socket part 5. The angular support is connected rotatably, but so that it cannot be pulled off, in the axial direction with the socket part 5 by means of a collar 9 of its limb 2 assigned to the socket part 5, the collar 9 engaging a radial recess 81 of the socket part 5 and an O ring seal 11, inserted in a circumferential groove 10 disposed in the recesses 81, forming the mutual seal between the socket part 5 and the angular plug support. In the embodiment shown, the surmountable locking device for fixing the angular support in a selectable, swiveled position with respect to the socket part 5, in the embodiment shown, comprises a number of rigid and flat locking surfaces 12, constructed tangentially to the outer periphery of the recess 81 of the socket part 5 in the region of the overlapping of the one limb 2 of the angular support with the socket part S and, with that, in the region, on the one hand, of the radial recesses 81 of the socket part 5 and, on the other, in the region of the corresponding, engaging collar 9 of the limb 2 assigned to the socket part 5 and, furthermore, a corresponding number of likewise flat surfaces, which are radially movable against a spring load, are presented in the form of leaf spring sections 13 and disposed in the inner periphery of the engaging collar 9 of the limb 2 of the support. The embodiment, shown in the drawing, is distinguished pursuant to the representation of FIG. 2 by the use of a total of eight pairings, on the one hand, of rigid surfaces 12 and, on the other, of surfaces, which are formed by leaf spring sections 13 and can be shifted radially against a spring load, the pairings being in each case equal in size and distributed uniformly over the periphery of the recessed region 8 of the socket part 5. As can be seen particularly from FIG. 2, the leaf spring sections 13, which form flat surfaces movable radially against a spring load and are disposed to bridge radially directed, groove-shaped recesses 14 in the inner periphery of the limb 2 of the support, are supported over supporting surfaces 16 formed at the edges of the groove-shaped recesses 14 with their side edges 15 on both sides aligned parallel to their longitudinal extent.

Figure 5:
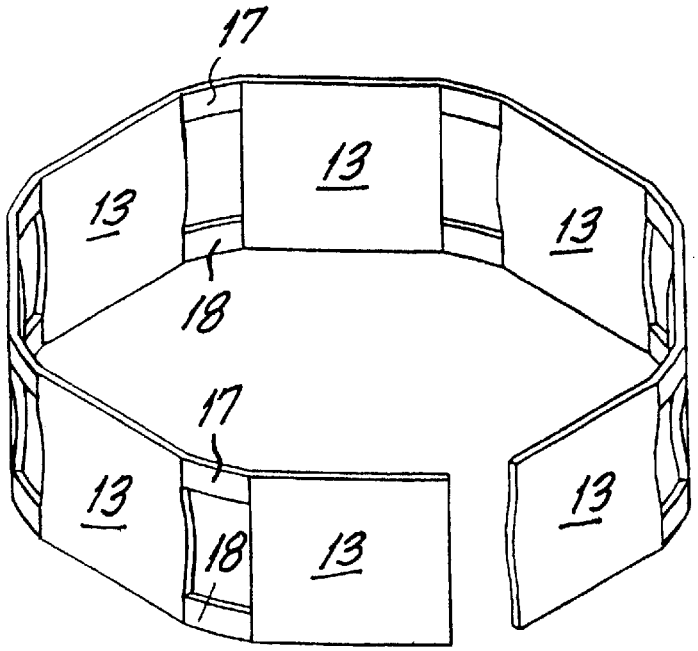
FIG. 5 shows a diagrammatic representation of a number of leaf spring sections, connected with one another to form a polyhedral ring body.
Figure 3:
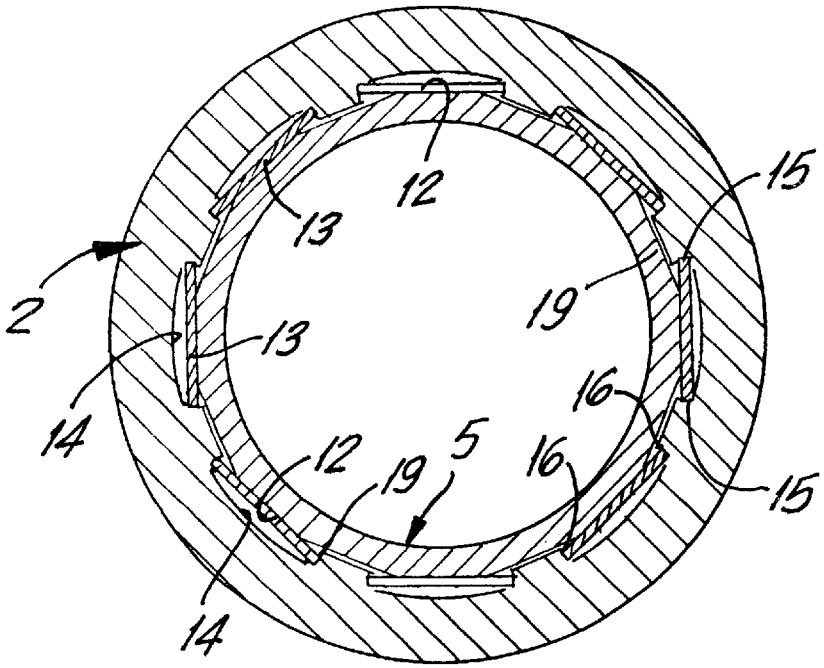
FIG. 3 shows a section through the plug support of FIG. 1 along the line III—III.
Figure 4:
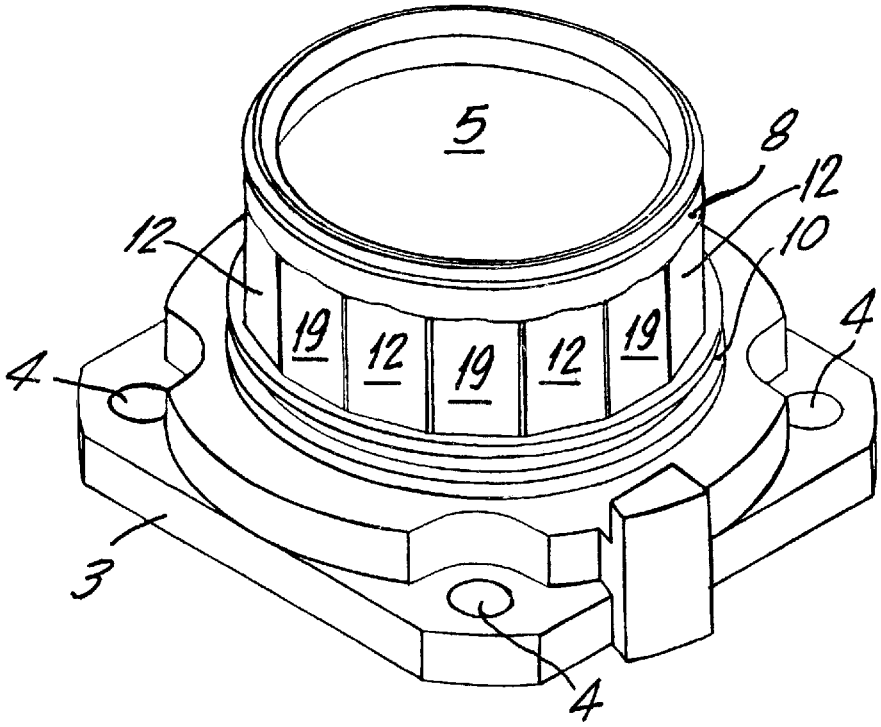
FIG. 4 shows a diagrammatic representation of the socket part of a plug support of FIG. 1

In the case of the embodiment shown in FIGS. 4 and 5, the leaf spring sections 13, forming surfaces movable radially against a spring load, have the same size and are provided in the unloaded state with a curvature facing the rigid opposite surfaces and are connected over bridges 17, 18 with a polygonal ring body, having the outline of a regular polygon. In a complementary matching configuration, the rigid flat surfaces 12, formed at the outer periphery of the socket part 5, and the spacer-like intermediate surfaces 19 are identical in size in such a manner, that they, in their totality, form the outline of a regular polygonal.

What is claimed is:

1. An angular plug support, comprising a socket part for being fixedly secured to a unit housing; an angular support part having a first limb for receiving a contact-retaining insulator, and a second limb overlapping the socket part with a possibility of rotation relative thereto but without a possibility of an axial displacement relative thereto; and locking means provided in a region of an overlapping of the socket part by the second limb for securing the angular support part in a selected rotational position thereof with respect to the socket part and for preventing disengagement of the second limb from the socket part, the locking means including a plurality of rigid flat surfaces provided on one of an outer periphery of the socket part and an inner periphery of the second limb, and a respective plurality of radially spring-biased surfaces provided at another of outer periphery of the socket part and the inner periphery of the second limb, the rigid flat surfaces and the radially springbiased surfaces substantially flatly abutting each other in a locking position of the socket and angular support parts.

2. An angular plug support according to claim 1, wherein there are provided an even number of the rigid flat surfaces and of the radially spring-biased surfaces.

3. An angular plug support according a claim 1, wherein the rigid flat surfaces are provided on the outer periphery of the socket part, extending tangentially to the periphery, and the radially spring-biased surfaces are provided at the inner periphery of the second limb.

4. An angular plug support according to claim 3, wherein the rigid flat surfaces and the radially spring-biased surfaces have the same size.

5. An angular plug support according to claim 3, wherein the regid flat surfaces and intermediate surfaces provided between adjacent ridig flat surgaces and having a same size as the rigid flat surfaces form a regular polygon in plan view.

6. An angular plug support according to claim 3, wherein the radially spring-biased surfaces are formed by leaf spring sections which are located in radially extending grooves formed in the inner periphery of the second limb.

7. An Angular plug support according to claim 6, wherein the leaf spring sections are connected with each other by spaced bridging webs, forming a body having a regular polygonal shape in plan view.

* * * * *